US007347902B2

(12) United States Patent
Mega et al.

(10) Patent No.: US 7,347,902 B2
(45) Date of Patent: Mar. 25, 2008

(54) HIGH TENSILE HOT ROLLED STEEL SHEET EXCELLENT IN SHAPE FREEZING PROPERTY AND ENDURANCE FATIGUE CHARACTERISTICS AFTER FORMING

(75) Inventors: Tetsuya Mega, Tokyo (JP); Kei Sakata, Tokyo (JP); Kazuhiro Seto, Tokyo (JP)

(73) Assignee: JFE Steel Corporation (JP)

( * ) Notice: Subject to any disclaimer, the term of this patent is extended or adjusted under 35 U.S.C. 154(b) by 298 days.

(21) Appl. No.: 10/479,773

(22) PCT Filed: Jun. 4, 2002

(86) PCT No.: PCT/JP02/05490

§ 371 (c)(1),
(2), (4) Date: Jul. 8, 2004

(87) PCT Pub. No.: WO02/103071

PCT Pub. Date: Dec. 27, 2002

(65) Prior Publication Data

US 2004/0238084 A1 Dec. 2, 2004

(30) Foreign Application Priority Data

Jun. 19, 2001 (JP) ..... 2001-184342
May 10, 2002 (JP) ..... 2002-135226

(51) Int. Cl.
*C22C 38/06* (2006.01)
*C22C 38/04* (2006.01)

(52) U.S. Cl. ..... 148/320; 420/128

(58) Field of Classification Search ..... 148/320, 148/334, 602, 653–654, 661; 420/105, 123, 420/128
See application file for complete search history.

(56) References Cited

U.S. PATENT DOCUMENTS 4,502,897 A 3/1985 Morita et al. ..... 148/12 F
6,425,963 B1 * 7/2002 Kaneko et al. ..... 148/320

FOREIGN PATENT DOCUMENTS

CN 1263168 A 8/2000
JP 410053837 * 2/1998
JP 11350064 A 12/1999
JP 2000 297349 A 10/2000

* cited by examiner

*Primary Examiner*—Deborah Yee
(74) *Attorney, Agent, or Firm*—DLA Piper US LLP

(57) ABSTRACT

According to the invention, a high-strength hot rolled steel sheet having an excellent shape fixability as hot-rolled and an excellent fatigue durability after the forming, excellent weldability and phosphatability and a tensile strength of not less than 590 MPa level can be obtained by comprising C: not less than 0.02 mass % but not more than 0.2 mass %, Si: not less than 0.5 mass % but not more than 2.0 mass %, Mn: not less than 1.0 mass % but not more than 3.0 mass %, Al: not less than 0.01 mass % but not more than 0.1 mass %, N: not less than 0.002 mass % but not more than 0.006 mass %, P: not more than 0.03 mass %, S: not more than 0.01 mass % and solid-soluted (C+N): not less than 0.0010 mass % and the reminder being Fe and inevitable impurities, and having a steel structure that a primary phase is ferrite and a secondary phase is martensite phase of 5-30 % at a volume ratio and a total of both is not less than 95 % as a volume ratio, and further having an average crystal grain size of ferrite of not more than 8 μm.

2 Claims, 1 Drawing Sheet

HIGH TENSILE HOT ROLLED STEEL SHEET EXCELLENT IN SHAPE FREEZING PROPERTY AND ENDURANCE FATIGUE CHARACTERISTICS AFTER FORMING

TECHNICAL FIELD

The technology in this disclosure relates to high-strength hot rolled steel sheets suitable for use in wheel disks and so on produced by subjecting to a baking after press forming, and having a tensile strength of not less than 590 MPa level and excellent shape fixability and fatigue durability after the forming as well as a method of producing the same.

BACKGROUND ART

Recently, it is advanced to increase a strength of a structural material for a vehicle body for the purpose of reducing a weight of an automotive vehicle body. Especially, it is attempted to use high-strength hot rolled steel sheets, which are also beneficial in view of the cost.

However, as the strength of the steel sheet is increased, the ductility generally lowers, and cracks, wrinkles and the like are apt to be easily created. Also, a spring back quantity is increased after the press forming to deteriorate the shape fixability and thereby lower the shape precision and hence there are caused problems such as dimension error and the like.

Particularly, the wheel disk is subjected to a baking after the press forming and then assembled into an automobile. Since this part is an important safety part relating to a running safeness of the automobile, it is required to have a severer durability to fatigue. In such a part, therefore, fatigue durability after the part forming-painting is also very important.

As the conventionally known high-strength hot rolled steel sheet, there are most generally so-called low-alloy and high-strength steel sheets (HSLA steel) obtained by adding not more than about 0.2 mass % of Nb or Ti, V and the like to a low-C steel.

That steel sheet has an advantage that the production can be conducted relatively easily and cheaply, but has a problem that the yield ratio is high and hence the shape fixability after the forming is poor.

In JP-A-60-181230 are proposed hot rolled steel sheets attempted by increasing the strength through a dual phase microstructure of ferrite and bainite. The ductility can be improved by such a microstructure form. In the microstructure having a secondary phase composed mainly of bainite, however, since the yield ratio is high, there is a problem that the shape fixability after the forming is poor likewise the HSLA steel.

In JP-B-56-54371 and JP-B-61-11291 are proposed steel sheets having a low yield stress and a good balance between strength and elongation in which a primary phase is ferrite and a secondary phase is a hard martensite phase.

However, such steel sheets indicate reasonable fatigue properties as a matrix, but when they are applied to the wheel disk for the automobile, there is left a problem that a higher fatigue durability is not obtained after the forming into parts.

It could therefore be advantageous to provide a high-strength hot rolled steel sheet having an excellent shape fixability as hot-rolled, an excellent fatigue durability after the forming and excellent weldability and phos-phatability and a tensile strength of not less than 590 MPa level as a first object.

It could also be helpful to provide a method of advantageously producing the above high-strength hot rolled steel sheet.

SUMMARY

By appropriately adjusting steel components and adequately controlling hot rolling conditions and subsequent cooling condition is optimized the microstructure, and the mechanical properties, particularly yield ratio are lowered as compared with the conventional ones. As a result, it is possible to progress plastic deformation at a low stress and hence the shape fixability is improved.

By rationalizing the steel components and hot rolling conditions likewise the above case and solid-soluting C and N as an interstitial solid-soluted element above a certain concentration can be improved a so-called bake hardenability bringing about the rise of the strength in the baking after the forming into an automotive part. As a result, the fatigue durability is considerably improved.

Also, the above rise of the strength after the forming can solve a problem of lowering the rigidity of the part due to the lowering of the yield stress, i.e. a problem of lowering the rigidity due to the fact that sufficient work hardening is not produced in sites of the part having low working degree.

The above knowledge is described in detail as follows.

By adding Mo to steel are refined initial austenite grains to make crystal grains of a final product fine. Also, the addition of Mo and further Cr improves the hardenability and has an effect of rendering the secondary phase into a microstructure mainly composed of martensite, so that the shape fixability is improved while lowering the yield ratio. Further, the balance between the strength and the elongation is improved by the refining of the crystal grains. Furthermore, Mo solid-solutes into ferrite to increase the tensile strength and strengthen soft ferrite grains and has an effect of improving the fatigue strength.

Since the amount of solid-soluted C is decreased by enrichment of C into martensite as a secondary phase and formation of fine carbide, in order to ensure an amount of interstitial solid-soluted elements (C+N) in ferrite, it is required to add N into steel. Thereby, the increase of the strength can be attained in the heat treatment at a baking step after the forming.

In order to secure the amount of the interstitial solid-soluted element in the ferrite, it is necessary to quench the sheet after ferrite transformation and coil at a low temperature. Thus, the diffusion of C from $\alpha$-phase to $\gamma$-phase can be suppressed to leave a great amount of solid-soluted C in the ferrite. Also, martensite transformation is easily caused after the cooling even in $\gamma$-phase having a relatively low C concentration by the quenching and low temperature coiling, and as a result the microstructure mainly composed of martensite can easily be obtained as the secondary phase.

That is, we provide steel sheets and methods as follows:

1. A high-strength hot rolled steel sheet having excellent shape fixability and fatigue durability after the forming, characterized by comprising C: not less than 0.02 mass % but not more than 0.2 mass %, Si: not less than 0.5 mass % but not more than 2.0 mass %, Mn: not less than 1.0 mass % but not more than 3.0 mass %, Al: not less than 0.01 mass % but not more than 0.1 mass %, N: not less than 0.002 mass % but not more than 0.006 mass %, P: not more than 0.03 mass %, S: not more than 0.01 mass % and solid-soluted (C+N): not less than 0.0010 mass % and the remainder being Fe and inevitable impurities, and having a steel structure that a primary phase is ferrite and a secondary phase is martensite phase of 5-30% at a volume ratio and a total of both is not less than 95% as a volume ratio, and an average crystal grain size of ferrite of not more than 8 μm.

2. A high-strength hot rolled steel sheet having excellent shape fixability and fatigue durability after the forming according to the item 1, wherein said steel sheet further contains one or more selected from the group consisting of Cr: not more than 0.2 mass %, Ca: not less than 0.001 mass % but not more than 0.005 mass % and REM: not less than 0.00 1 mass % but not more than 0.005 mass %.

3. A method of producing a high-strength hot rolled steel sheet having excellent shape fixability and fatigue durability after the forming, characterized in that a slab of a steel comprising C: not less than 0.02 mass % but not more than 0.2 mass %, Si: not less than 0.5 mass % but not more than 2.0 mass %, Mn: not less than 1.0 mass % but not more than 3.0 mass %, Al: not less than 0.01 mass % but not more than 0.1 mass %, N: not less than 0.002 mass % but not more than 0.006 mass %, P: not more than 0.03 mass %, 5: not more than 0.01 mass % and the remainder being Fe and inevitable impurities is hot rolled under conditions that a finish rolling temperature is not lower than $Ar_3$ point but not higher than ($Ar_3$ point+100° C.), and then cooled to not higher than 750° C. but not lower than 650° C. and retained in this temperature range for not less than 2 seconds but not more than 20 seconds and thereafter cooled at a cooling rate of not less than 20° C./s and coiled at a temperature of not higher than 350° C.

4. A method of producing a high-strength hot rolled steel sheet having excellent shape fixability and fatigue durability after the forming according to the item 3, wherein said steel slab further contains one or more selected from the group consisting of Cr: not more than 0.2 mass %, Ca: not less than 0.001 mass % but not more than 0.005 mass % and REM: not less than 0.001 mass % but not more than 0.005 mass %.

DETAILED DESCRIPTION

Figure 1:
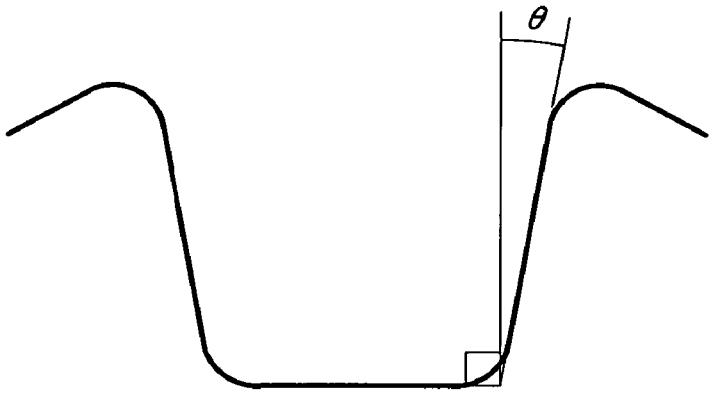
FIG. 1 is a view illustrating an evaluation method for a shape fixability.

At first, the reason why the component compositions of the steel are limited to the above ranges is described below.

C is an essential element for increasing the tensile strength, providing martensite as a low temperature transformation forming structure and ensuring solid-soluted (C+N) amount. The C amount is required to be at least 0.02 mass %, but when it exceeds 0.2 mass %, the secondary phase is considerably increased to bring about the lowering of the ductility and the rapid deterioration of the weldability, so that the C amount is limited to a range of from not less than 0.02 mass % to not more than 0.2 mass %.

Si: not less than 0.5 mass % but not more than 2.0 mass %

Si is large in the performance strengthening the solid solution and is a useful element capable of increasing the strength without damaging the yield ratio and the balance between strength and elongation. Also, Si effectively contributes to activate transformation from γ-phase to α-phase to promote enrichment of C into γ-phase and form a mixed microstructure of ferrite and martensite. Further, Si is an element useful for purifying steel as a deoxidizing element in steel making.

Moreover, Si is an element useful for controlling the formation of a carbide such as $Fe_3C$ or the like in steel to form a dual phase microstructure of ferrite and martensite and hence lower the yield ratio. In addition, Si has an effect that it is solid-soluted into ferrite to increase the tensile strength and strengthen soft ferrite grains to improve the fatigue strength.

However, when the Si amount is less than 0.5 mass %, the addition effect is not obtained, while when it exceeds 2.0 mass %, the effect is saturated. Also, when the Si amount exceeds 2.0 mass %, a scale that may peel from the surface is produced to bring about the deterioration of surface properties and the deterioration of phosphatability. Therefore, the Si amount is limited to a range of from not less than 0.5 mass % to not more than 2.0 mass %.

Mn has an effect not only contributing to the improvement of the strength but also improving the hardenability to easily render the secondary phase into martensite phase. Also, Mn has an effect of precipitating solid-soluted S, which is a cause of brittle crack in the hot working, as MnS to defuse it. Such effects can not be too expected when the Mn amount is less than 1.0 mass %. On the other hand, when the Mn amount exceeds 3.0 mass %, the strength increases to considerably lower the ductility, which badly affects the invention such as the deterioration of the weldability and the like. Therefore, the Mn amount is limited to a range of from not less than 1.0 mass % to not more than 3.0 mass %. Preferably, it is within a range of from not less than 1.0 mass % to not more than 2.5 mass %.

Mo: not less than 0.1 mass % but not more than 0.6 mass %

Mo: not less than 0.1 mass % but not more than 0.6 mass %

Mo is particularly an important element. Mo effectively contributes not only to the strength but also to the improvement of the shape fixability by giving the hardenability to steel to facilitate the formation of the microstructure consisting of ferrite and martensite and lower the yield ratio. Also, Mo has an effect of refining crystal grains to improve the balance between strength and elongation. Further, Mo is solid-soluted into ferrite to raise the tensile strength and acts to strengthen soft ferrite grains to improve the fatigue strength. In order to develop the above effects, it is required to add Mo in an amount of at least 0.1 mass %. However, when the MO amount exceeds 0.6 mass %, the above effects are saturated but also there is a fear that carbo-nitride is formed by binding to C, N in ferrite to decrease solid-soluted (C+N) amount and lower the bake hardenability. Also, too much Mo can cause disadvantages such as the rise of cost, deterioration of weldability and the like. Therefore, the Mo amount is limited to a range of from not less than 0.1 mass % to not more than 0.6 mass %.

Al effectively serves as a deoxidizing agent, but when the Al amount is less than 0.01%, the sufficient addition effect is not obtained. On the other hand, when the Al amount exceeds 0.1 mass %, the addition effect is saturated but also the cost increases and the brittleness of the steel is caused. Therefore, the Al amount is limited to a range of from not less than 0.01 mass % to not more than 0.1 mass %. Preferably, it is a range of from not less than 0.03 mass % to not more than 0.1 mass %.

N: not less than 0.002 mass % but not more than 0.006 mass %

N is an element useful for solid-soluting into ferrite to raise the hardness of ferrite likewise C. However, when the N amount is less than 0.002 mass %, the sufficient addition effect is not obtained. While, when the N amount exceeds 0.006 mass %, the considerable deterioration of the ductility is caused. Therefore, the N amount is limited to a range of from not less than 0.002 mass % to not more than 0.006 mass %. Preferably, it is not less than 0.003 mass %.

Solid-soluted (C+N): not less than 0.0010 mass %

Dislocation introduced in the forming by ensuring an appropriate amount of solid-soluted (C+N) is caught by solid-soluted element in steel, mainly C, N solid-soluted in ferrite to rest in ferrite and raise the hardness of ferrite. Thus, the bake hardenability is improved and also the fatigue durability is improved. However, the solid-soluted (C+N) amount is less than 0.0010 mass % in total, the above effect is not obtained, so that they are solid-soluted in the invention when (C+N) is a range of not less than 0.0010 mass %. Moreover, the upper limit of the solid-soluted (C+N) is not particularly limited, but is preferable to be about 0.0050 mass %.

P: not more than 0.03 mass %

P is a harmful element. If a great amount of P is included, the weldability is deteriorated and also the brittleness at grain boundary is induced, so that it is desirable to reduce the P amount as far as possible. Particularly, when the P amount exceeds 0.03 mass %, the above bad influence becomes remarkable, so that the P amount is controlled to not more than 0.03 mass %. Moreover, the lower limit of the P amount is preferable to be about 0.005 mass % from a viewpoint of the production without taking a great steel-making cost.

S: not more than 0.01 mass % s is an element considerably deteriorating the hot workability, toughness and weldability. Particularly, when the S amount exceeds 0.01 mass %, these harmful results become large. Also, the addition of a great amount of S is a cause of coarsening crystal grains. Further, when a great amount of S is added, coarse inclusions increase to deteriorate the fatigue durability. Therefore, the S amount is controlled to not more than 0.01 mass %. Preferably, it is not more than 0.005 mass %. Moreover, when S is decreased to a value of lower than 0.001 mass % in the existing refinement technique, the steel making cost considerably increases, so that the lower limit of the S amount is preferable to be about 0.001 mass %.

Although the above is explained with respect to essential components, the following components may be properly included in addition to the above essential components in the invention.

Cr: not more than 0.2 mass %

Cr effectively contributes to improve the hardenability and ensure a solid-soluted element(s) to increase the strength but also is an element effective for obtaining a mixed microstructure of ferrite and martensite. Also, Cr is an element useful for controlling pearite transformation to stabilize the austenite phase as a secondary phase in the hot rolling. In order to obtain these effects, the Cr amount is preferable to be not less than 0.05 mass %. However, when the Cr amount exceeds 0.2 mass %, it strongly binds to C in ferrite to form Cr carbonitride and hence cause a harmful result of decreasing the solid-soluted (C+N) amount. Also, when the Cr amount exceeds 0.2 mass %, the remarkable lowering of the phosphatability is brought but also the weldability is badly affected and further the addition cost becomes large. Therefore, Cr is included in an amount of not more than 0.2 mass %.

Ca has an action of refining sulfide and effectively contributes to improve the elongation and fatigue durability. However, when the Ca amount is less than 0.001 mass %, the sufficient addition effect is not obtained. While, when the Ca amount exceeds 0.005 mass %, the addition effect is saturated and becomes uneconomical and the purifying degree of steel is lowered. Also, when the Ca amount exceeds 0.005 mass %, the crystal grains are coarsened to bring about the deterioration of the fatigue durability. Therefore, Ca is included in an amount of not less than 0.001 mass % but not more than 0.005 mass %. REM: not less than 0.001 mass % but not more than 0.005 mass %

REM (rare earth element) has an effect of controlling the form of sulfide to improve the elongation and fatigue durability likewise Ca. Therefore, REM is included in an amount of not less than 0.001 mass % but not more than 0.005 mass % from the same reason as mentioned in Ca.

Although the above is explained as the preferable composition range, only the limitation of the composition to the above range is insufficient, and also it is important to render the steel microstructure into a give microstructure.

That is, it is necessary that ferrite is a primary phase and martensite as a secondary phase is controlled to a range of 5-30% as a volume ratio to total microstructure.

By controlling martensite percentage to a proper range, the yield ratio can be lowered to improve the shape fixability. Also, the above control has an effect of increasing the work hardened amount, so that it is effective in a point of ensuring the rigidity. Further, the balance between tensile strength and elongation becomes good at a strength level of not less than 590 MPa, the deterioration of the forming property for automobile parts due to the rise of the strength in the steel sheet can be prevented effectively.

The above effect is developed when the martensite percentage is not less than 5%, but when the percentage exceeds 30%, the effect is saturated and also the harmful result of decreasing the solid-soluted (C+N) amount in ferrite is caused. Therefore, the amount of martensite as a secondary phase is limited to a range of 5-30% as a volume ratio. Preferably, it is 10-18%.

Moreover, bainite phase, pearite phase and the like may be produced as the other phase. If these phases are not less than 5% as a volume ratio, the yield ratio of the steel sheet increases, so that it is required to control the volume ratio to less than 5%. That is, the total of ferrite phase and martensite phase is required to be not less than 95% as a volume ratio.

Also, it is important to render an average crystal grain size of ferrite into not more than 8 μm.

That is, in order to simultaneously establish the forming property and the fatigue durability, it is required to improve the balance between strength and elongation and hence it is effective to attain the refining of the crystal grains. By refining the crystal grains can be increased the strength without deteriorating the elongation characteristic. Thereby, the formation of fine cracks in the forming is decreased. Also, as the crystal grains become finer, the growth of cracks is less and the fatigue durability is improved. The above effect considerably develops when the grain size of ferrite is not more than 8 μm, but if it exceeds 8 μm, the effect decreases, so that the average crystal grain size of ferrite is limited to not more than 8 μm. More preferably, it is not more than 6 μm.

The production method will be described below.

The production means of the steel slab is not particularly limited, but the conventionally known continuous casting method and ingot making-blooming method can be used.

In the hot rolling, it is important to control a rolling completion temperature to a range of from not lower than $Ar_3$ point to not higher than ($Ar_3$ point+100° C.). Because, proper grain growth of austenite (γ) can be caused by completing the rolling at the above temperature range, and subsequently transformation to ferrite phase (α) and grain growth of ferrite are caused in a retention treatment after the cooling, whereby the dual phase microstructure of ferrite and martensite can be effectively formed. In this point, when the finish rolling temperature exceeds ($Ar_3$ point+100° C.), the grain size of austenite becomes coarse and hence the refining of ferrite grain size can not be attained and the lowering of the balance between strength and elongation is caused. On the other hand, when the finish rolling temperature is lower than $Ar_3$ point, the accumulation of strain becomes large and the precipitation of ferrite phase excessively proceeds in a slow cooling process after the subsequent cooling and hence the percentage of martensite as a secondary phase lowers. Further, as the finish rolling temperature becomes lower, the ferrite phase renders into ductile grains, which badly affect both the forming property and the fatigue durability. More preferably, the finish rolling temperature is within a range of from not lower than $Ar_3$ point to not higher than ($Ar_3$ point+50° C.).

After the above hot rolling, the steel sheet is cooled to a temperature region of not higher than 750° C. but not lower than 650° C. and then retained at this temperature region for not less than 2 seconds but not more than 20 seconds. When the retention temperature is outside the above temperature region, the start of the retention treatment comes off from a precipitation nose of ferrite phase and hence ferrite transformation becomes longer at the retention treatment or a slow cooling process by air cooling or the like. By retaining the above temperature region for the above time is promoted α-γ dual phase separation to obtain a dual phase microstructure of ferrite and martensite and lower the yield ratio and improve the shape fixability. In this connection, when the retention temperature exceeds 750° C. or is lower than 650° C., the α-γ dual phase separation is not promoted. More preferably, the retention temperature region is not higher than 720° C. but not lower than 680° C. Moreover, the retention treatment may be a keeping treatment keeping a constant temperature in addition to the above slow cooling treatment.

Also, when the retention time is less than 2 seconds, the dual phase separation from γ to α is not progressed and the enrichment of C in austenite is insufficient and the transformation of martensite as a secondary phase hardly occurs at the subsequent coiling step and hence the target microstructure is not obtained. On the other hand, when the retention time exceeds 20 seconds, the solid-soluted C, N in ferrite is decreased by diffusing into austenite or in the grain boundary and finally it is difficult to ensure the amount of solid-soluted (C+N). Further, there is caused a fear that the grain size of ferrite exceeds 8 μm. Therefore, the retention time at the temperature region of from not higher than 750° C. to not lower than 650° C. is limited to a range of from not less than 2 seconds to not more than 20 seconds. More preferably, the retention time is not less than 4 seconds but not more than 8 seconds. Moreover, the cooling rate for cooling to a temperature region of not higher than 750° C. but not lower than 650° C. after the hot rolling is not particularly limited. The cooling rate is sufficient to be about 15-40° C./s, which is usually used.

Thereafter, the steel sheet is cooled at a cooling rate of not less than 20° C./s and coiled at a temperature of not higher than 350° C. Because, this procedure is to obtain a desired ferrite-martensite microstructure and ensure a sufficient amount of solid-soluted (C+N). That is, when the cooling rate is less than 20° C./s, the secondary phase having a less enriched amount of C hardly causes martensite transformation, and the percentage of martensite decreases and bainite is easily produced. Also, as the cooling rate becomes less than 20° C/s, C, N are diffused into the grain boundary and the secondary phase in the cooling process to lower the concentration in ferrite and finally it is difficult to ensure a given amount of solid-soluted (C+N). On the other hand, when the coiling temperature exceeds 350° C., the formation of pearite and bainite is easily caused, and also C, N are diffused after the coiling to decrease the amount of solid-soluted (C+N) in ferrite and hence it is difficult to ensure a necessary amount of solid-soluted (C+N). More preferably, the cooling rate is not less than 30° C/s, and the coiling temperature is not higher than 250° C.

A slab of steel having a chemical composition shown in Table 1 is treated under various conditions shown in Table 2 to obtain a hot rolled steel sheet having a thickness of 3.5 mm.

Then, the thus obtained hot rolled steel sheets are subjected to a pickling and then examined on a microstructure of steel, an average crystal grain size of ferrite and an amount of solid-soluted (C+N) to obtain results as shown in Table 3.

Also, the mechanical properties, shape fixability, fatigue durability, phosphatability and weldability of the hot rolled steel sheets are examined to obtain results as shown in Table 4.

Moreover, the average crystal grain size of ferrite is measured according to a cutting method in ferrite grain size determination for steel defined in JIS G0552 on a photograph with an electron microscope.

Also, the volume ratios of ferrite and martensite are determined by image-processing an electron microphotograph to measure percentages of ferrite and martensite (area ratio) as a volume ratio.

Further, the measurement of solid-soluted (C+N) concentration is carried out by an internal friction method under conditions of frequency: 1 Hz and test temperature: room temperature.

Furthermore, various properties are evaluated as follows.

Shape Fixability:

A test specimen having a width of 50 mm and a length of 100 mm is cut out from the steel sheet in the rolling direction as a longitudinal direction, which is shaped into a hat bent form in a mold and taken out therefrom as shown in FIG. 1, and thereafter the shape fixability is evaluated by a warp angle 0 produced in a longitudinal wall portion at a punch shoulder having a radius of 5 mm. Moreover, an adequate warp angle is $\theta \leqq 4°$ in case of TS $\leqq$700 MPa and $\theta \leqq 6°$ in case of TS>700 MPa considering the shape of the mold and the forming precision after the press forming.

Figure 2:
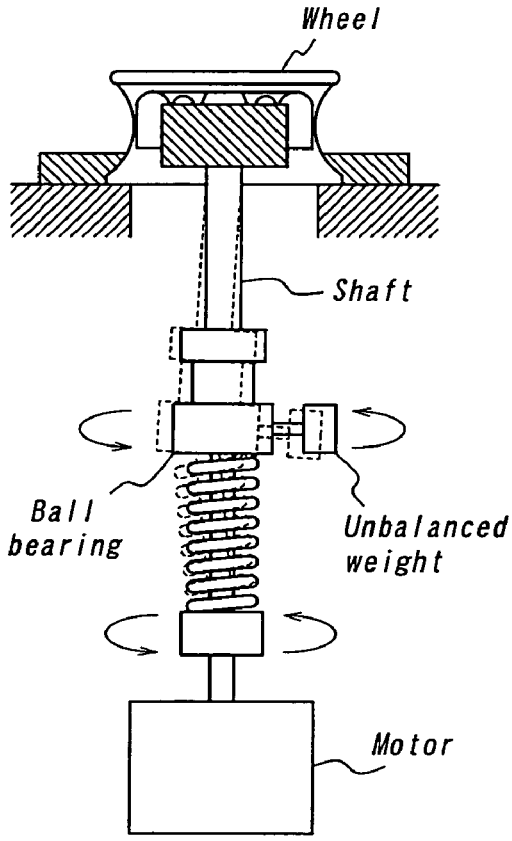
FIG. 2 is a schematic view of a test method for fatigue durability—an apparatus for bending moment durable test.

Fatigue Durability:

In the test for the fatigue durability is used an apparatus for bending moment durable test as shown in FIG. 2. A wheel to be tested is formed by forming a disk in a mold and spot-welding a rim portion thereto and subjecting to a baking at 170° C. The test is carried out under conditions of a loading moment: 2000 N·m and a rotating frequency: 20 Hz. When fine fatigue crack is created in the disk portion, the test is stopped and the fatigue durability is evaluated by a rotating number in the stopping of the test. The detection of the fine fatigue crack is carried out by applying a fine label onto the surface of the wheel disk, irradiating a laser beam to the label, continuously detecting a reflecting light with a detector to measure a change of an intensity, during which the fatigue durability is evaluated by the rotating number of a loading arm. In order to apply the steel sheet to a wheel, it is necessary that the rotating number is not less than 200,000 times as a test result for fatigue durability.

Further, the mechanical properties are examined by using a tensile test specimen of JIS No. 5 taken out from a steel sheet having a thickness of 3.5 mm in a widthwise direction (C-direction) perpendicular to a rolling direction and subjecting to a tensile test.

The phosphatability is evaluated by washing and degreasing a test steel sheet having a mass ($W_0$), immersing in a solution containing a chemical (solution of zinc phosphate) for a constant time, again washing and measuring a mass (W) to determine an increment of mass ($W-W_0$) per unit area due to the adhesion of zinc phosphate crystal. A target value is not less than 2.0 g/m$^2$.

The weldability is evaluated by measuring a tensile strength of a weld portion through a tensile testing machine after the arc welding, in which the tensile strength larger than that of a matrix is acceptable (○).

TABLE 1

| Symbol of steel | Chemical composition (mass %) C | Si | Mn | Mo | Al | N | P | S | others | $Ar_3$ (° C.) | Remarks |
|---|---|---|---|---|---|---|---|---|---|---|---|
| A | 0.04 | 1.1 | 1.4 | 0.30 | 0.031 | 0.006 | 0.012 | 0.005 | — | 880 | Invention steel |
| B | 0.17 | 1.5 | 2.2 | 0.40 | 0.032 | 0.005 | 0.010 | 0.007 | — | 840 | " |
| C | 0.05 | 1.0 | 1.2 | 0.20 | 0.030 | 0.005 | 0.013 | 0.007 | Cr: 0.1, Ca: 0.002 | 870 | " |
| D | 0.08 | 1.2 | 1.0 | 0.30 | 0.032 | 0.003 | 0.012 | 0.006 | REM: 0.003 | 880 | " |
| E | 0.05 | 1.2 | 1.2 | 0.20 | 0.030 | 0.005 | 0.010 | 0.006 | Cr: 0.2 | 880 | " |
| F | 0.16 | 0.7 | 2.5 | 0.50 | 0.030 | 0.003 | 0.011 | 0.008 | — | 820 | " |
| G | 0.10 | 1.0 | 1.3 | 0.20 | 0.032 | 0.004 | 0.010 | 0.030 | Cr: 0.5 | 856 | Comparative steel |
| H | 0.08 | 0.01 | 2.0 | 1.20 | 0.035 | 0.003 | 0.012 | 0.007 | Ca: 0.002 | 850 | " |
| I | 0.01 | 2.3 | 1.8 | 0.40 | 0.035 | 0.001 | 0.011 | 0.005 | — | 907 | " |
| J | 0.12 | 1.4 | 0.7 | 0.50 | 0.034 | 0.003 | 0.050 | 0.007 | REM: 0.01 | 900 | " |
| K | 0.25 | 0.6 | 0.5 | 0.30 | 0.030 | 0.003 | 0.011 | 0.006 | — | 850 | " |
| L | 0.18 | 1.7 | 3.5 | 0.50 | 0.200 | 0.010 | 0.011 | 0.006 | Cr: 0.1 | 810 | " |
| M | 0.08 | 1.2 | 1.5 | — | 0.033 | 0.005 | 0.011 | 0.020 | Ca: 0.01 | 860 | " |
| N | 0.15 | 0.2 | 3.0 | — | 0.033 | 0.005 | 0.011 | 0.008 | Cr: 0.4 | 770 | " |

TABLE 2

| No. | Symbol of steel | Treating conditions *1 FDT (° C.) | $CR_1$ (° C./s) | $T_1$ (° C.) | $T_2$ (° C.) | $t_1$ (S) | $CR_2$ (° C./s) | CT (° C.) | Remarks |
|---|---|---|---|---|---|---|---|---|---|
| 1 | A | 880 | 25 | 680 | 650 | 4 | 30 | 220 | Invention Example |
| 2 | " | 910 | 30 | 720 | 680 | 5 | 35 | 200 | Invention Example |
| 3 | " | 890 | 25 | 730 | 700 | 3 | 10 | 300 | Comparative Example |
| 4 | " | 820 | 20 | 710 | 670 | 5 | 32 | 260 | Comparative Example |
| 5 | " | 900 | 20 | 720 | 670 | 7 | 28 | 450 | Comparative Example |
| 6 | " | 920 | 30 | 780 | 740 | 4 | 28 | 200 | Comparative Example |
| 7 | B | 870 | 20 | 700 | 660 | 4 | 32 | 240 | Invention Example |
| 8 | " | 900 | 25 | 670 | 650 | 35 | 35 | 250 | Comparative Example |
| 9 | " | 880 | 25 | 720 | 700 | 2 | 8 | 500 | Comparative Example |
| 10 | " | 840 | 30 | 600 | 580 | 10 | 36 | 300 | Comparative Example |
| 11 | " | 960 | 30 | 730 | 690 | 4 | 28 | 220 | Comparative Example |
| 12 | C | 880 | 20 | 700 | 650 | 5 | 35 | 210 | Invention Example |
| 13 | " | 890 | 25 | 680 | 680 | 8 | 30 | 220 | Invention Example |
| 14 | " | 880 | 20 | 720 | 720 | <1 | 42 | 250 | Comparative Example |
| 15 | D | 900 | 30 | 720 | 680 | 6 | 28 | 220 | Invention Example |
| 16 | E | 890 | 20 | 700 | 670 | 5 | 30 | 220 | Invention Example |
| 17 | F | 850 | 25 | 720 | 690 | 4 | 35 | 250 | Invention Example |
| 18 | " | 800 | 30 | 660 | 660 | <1 | 45 | 200 | Comparative Example |
| 19 | G | 880 | 25 | 730 | 700 | 4 | 32 | 200 | Comparative Example |

TABLE 2-continued

| No. | Symbol of steel | Treating conditions *1 FDT (° C.) | $CR_1$ (° C./s) | $T_1$ (° C.) | $T_2$ (° C.) | $t_1$ (S) | $CR_2$ (° C./s) | CT (° C.) | Remarks |
|---|---|---|---|---|---|---|---|---|---|
| 20 | H | 870 | 25 | 650 | 650 | 5 | 28 | 250 | Comparative Example |
| 21 | I | 930 | 30 | 740 | 650 | 15 | 30 | 200 | Comparative Example |
| 22 | J | 900 | 25 | 720 | 690 | 3 | 33 | 300 | Comparative Example |
| 23 | K | 900 | 25 | 720 | 700 | 2 | 40 | 260 | Comparative Example |
| 24 | L | 850 | 20 | 680 | 660 | 7 | 28 | 220 | Comparative Example |
| 25 | M | 880 | 25 | 700 | 670 | 3 | 28 | 200 | Comparative Example |
| 26 | N | 820 | 25 | 710 | 660 | 6 | 35 | 200 | Comparative Example |

*1 FDT: finish rolling completion temperature, $CR_1$: cooling rate up to start of retention after the rolling (average cooling rate between FDT (° C.) and $T_1$), $T_1$: cooling temperature after the rolling, $T_2$: temperature in the completion of the retention, $t_1$: retention time between $T_1$ and $T_2$, $CR_2$: cooling rate up to coiling after the retention average cooling rate from $T_2$ to CT), CT: coiling temperature

TABLE 3

| No. | Symbol of steel | Steel microstructure Average grain size of ferrite (μm) | Volume ratio of ferrite (%) | Microstructure of secondary phase *2 | Volume ratio of martensite (%) | Volume ratio of ferrite + martensite (%) | Solid-soluted (C + N) amount (mass %) | Remarks |
|---|---|---|---|---|---|---|---|---|
| 1 | A | 5.6 | 88 | M | 12 | 100 | 0.0024 | Invention Example |
| 2 | " | 6.5 | 90 | M | 10 | 100 | 0.0032 | " |
| 3 | " | 8.0 | 85 | M + B | 5 | 90 | 0.0002 | Comparative Example |
| 4 | " | 9.2 | 93 | M + B | 2 | 95 | 0.0006 | " |
| 5 | " | 7.3 | 80 | B | 0 | 80 | 0.0002 | " |
| 6 | " | 10.6 | 92 | B | 0 | 92 | 0.0015 | " |
| 7 | B | 5.2 | 78 | M | 20 | 98 | 0.0045 | Invention Example |
| 8 | " | 12.0 | 85 | P + M + B | 4 | 89 | 0.0006 | Comparative Example |
| 9 | " | 8.9 | 80 | P + M + B | 0 | 80 | 0.0008 | " |
| 10 | " | 8.0 | 83 | M + B | 5 | 88 | 0.0028 | " |
| 11 | " | 18.0 | 68 | M + B | 10 | 78 | 0.0020 | " |
| 12 | C | 4.8 | 92 | M | 8 | 100 | 0.0026 | Invention Example |
| 13 | " | 5.8 | 88 | M | 12 | 100 | 0.0023 | " |
| 14 | " | 8.0 | 88 | M + B | 2 | 90 | 0.0017 | Comparative Example |
| 15 | D | 7.0 | 85 | M | 15 | 100 | 0.0025 | Invention Example |
| 16 | E | 5.6 | 86 | M | 14 | 100 | 0.0018 | " |
| 17 | F | 4.5 | 68 | M | 28 | 96 | 0.0050 | " |
| 18 | " | 4.0 | 60 | M + B | 15 | 75 | 0.0020 | Comparative Example |
| 19 | G | 7.8 | 84 | M | 16 | 100 | 0.0002 | " |
| 20 | H | 5.2 | 86 | B | 0 | 86 | 0.0005 | " |
| 21 | I | 8.6 | 96 | M + B | 2 | 98 | <0.0001 | " |
| 22 | J | 10.6 | 80 | B | 0 | 80 | 0.0022 | " |
| 23 | K | 9.3 | 65 | M + B | 5 | 70 | 0.0034 | " |
| 24 | L | 7.8 | 56 | B + M | 8 | 64 | 0.0050 | " |
| 25 | M | 11.7 | 90 | M | 10 | 100 | 0.0028 | " |
| 26 | N | 9.2 | 70 | M | 26 | 96 | 0.0004 | " |

*2 M: martensite phase,
B: bainite phase,
P: pearite phase

TABLE 4

| No. | Symbol of steel | Properties: YS (MPa) | TS (MPa) | El (%) | YR (%) | Shape fixability θ (°) | Result of bending moment durable test ($\times 10^4$ times) | Weight of chemical coating ($g/m^2$) | Weldability | Remarks |
|---|---|---|---|---|---|---|---|---|---|---|
| 1 | A | 355 | 618 | 33 | 57 | 2 | 25 | 3.6 | ○ | Invention Example |
| 2 | " | 347 | 598 | 34 | 58 | 2 | 24 | 3.2 | ○ | " |
| 3 | " | 473 | 610 | 31 | 78 | 7 | 13 | 3.2 | ○ | Comparative Example |
| 4 | " | 377 | 545 | 36 | 69 | 2 | 9 | 3.5 | ○ | " |
| 5 | " | 495 | 605 | 29 | 82 | 7 | 14 | 3.2 | ○ | " |
| 6 | " | 438 | 550 | 35 | 80 | 5 | 21 | 3.2 | ○ | " |
| 7 | B | 479 | 814 | 28 | 59 | 4 | 45 | 3.0 | ○ | Invention Example |
| 8 | " | 614 | 760 | 21 | 81 | 9 | 15 | 2.8 | ○ | Comparative Example |
| 9 | " | 649 | 796 | 23 | 82 | 9 | 12 | 2.9 | ○ | " |
| 10 | " | 658 | 809 | 24 | 81 | 10 | 30 | 2.7 | ○ | " |
| 11 | " | 571 | 712 | 30 | 80 | 8 | 28 | 2.8 | ○ | " |
| 12 | C | 338 | 615 | 35 | 55 | 2 | 29 | 3.1 | ○ | Invention Example |
| 13 | " | 327 | 620 | 34 | 53 | 2 | 36 | 3.0 | ○ | " |
| 14 | " | 472 | 630 | 31 | 75 | 5 | 26 | 3.1 | ○ | Comparative Example |
| 15 | D | 356 | 634 | 31 | 56 | 2 | 31 | 3.2 | ○ | Invention Example |
| 16 | E | 335 | 630 | 34 | 53 | 2 | 35 | 3.0 | ○ | " |
| 17 | F | 644 | 1002 | 18 | 64 | 5 | 33 | 2.4 | ○ | " |
| 18 | " | 897 | 1089 | 10 | 82 | 12 | 8 | 2.4 | ○ | Comparative Example |
| 19 | G | 343 | 607 | 33 | 57 | 2 | 8 | 0.8 | X | " |
| 20 | H | 507 | 630 | 31 | 80 | 7 | 10 | 3.2 | ○ | " |
| 21 | I | 351 | 452 | 41 | 78 | 5 | 5 | 2.2 | ○ | " |
| 22 | J | 562 | 666 | 28 | 84 | 7 | 21 | 2.9 | X | " |
| 23 | K | 533 | 658 | 22 | 81 | 7 | 28 | 3.4 | X | " |
| 24 | L | 655 | 803 | 25 | 82 | 9 | 35 | 2.5 | X | " |
| 25 | M | 415 | 625 | 27 | 66 | 2 | 8 | 3.1 | X | " |
| 26 | N | 636 | 1026 | 9 | 62 | 5 | 11 | 1.0 | X | " |

As seen from Table 4, all of the exemplary hot rolled steel sheets are excellent mechanical properties and have excellent shape fixability and fatigue durability and further are excellent in the phosphatability and weldability.

INDUSTRIAL APPLICABILITY

High-strength hot rolled steel sheets having a high strength and a high elongation at a tensile strength level of not less than 590 MPa, which are excellent in the press forming property and the shape fixability after the forming, and are also excellent in the fatigue durability after the baking and further excellent in the phosphatability and weldability can be stably provided.

The invention claimed is:

1. A high-strength hot rolled steel sheet having excellent shape fixability and fatigue durability after forming comprising: C: not less than 0.02 mass % but not more than 0.2 mass %, Si: not less than 0.5 mass % but not more than 2.0 mass %, Mn: not less than 1.0 mass % but not more than 3.0 mass %, Al: not less than 0.01 mass % but not more than 0.1 mass %, N: not less than 0.002 mass % but not more than 0.006 mass %, P: not more than 0.03 mass %, S: not more than 0.01 mass % and solid-soluted (C+N): not less than 0.0010 mass % and the remainder being Fe and inevitable impurities, and having a steel structure that a primary phase is ferrite and a secondary phase is martensite phase of 5-30% at a volume ratio and a total of both is not less than 95% as a volume ratio, and an average crystal grain size of ferrite of not more than 8 μm, and 0.001 to 0.005% of the solid-soluted C. N is present in grains of the ferrite.

2. The steel sheet according to claim 1, wherein said steel sheet further contains one or more selected from the group consisting of Cr: not more than 0.2mass %, Ca: not less than 0.001 mass % but not more than 0.005 mass % and REM: not less than 0.001 mass % but not more than 0.005 mass %.

* * * * *

UNITED STATES PATENT AND TRADEMARK OFFICE

CERTIFICATE OF CORRECTION

PATENT NO. : 7,347,902 B2
APPLICATION NO. : 10/479773
DATED : March 25, 2008
INVENTOR(S) : Mega et al.

It is certified that error appears in the above-identified patent and that said Letters Patent is hereby corrected as shown below:

In Column 3:

At line 10, please change "0.00 1" to --0.001--; at line 19, please change "5" to --S--; at line 47, after the paragraph ending in "described below.", please insert the paragraph heading --C: not less than 0.02 mass % but not more than 0.2 mass %--.

In Column 4:

At line 51, after the paragraph ending in "0.6 mass %.", please insert the paragraph heading --A1: not less than 0.01 mass % but not more than 0.1 mass %--.

In Column 8:

At line 47, please change "0" to --θ--.

Signed and Sealed this

Twenty-ninth Day of July, 2008

JON W. DUDAS
*Director of the United States Patent and Trademark Office*